US012454777B2

(12) United States Patent
Vela

(10) Patent No.: US 12,454,777 B2
(45) Date of Patent: Oct. 28, 2025

(54) CROCHET ASSISTANCE APPARATUS

(71) Applicant: James Edward Vela, Maitland, FL (US)

(72) Inventor: James Edward Vela, Maitland, FL (US)

( * ) Notice: Subject to any disclaimer, the term of this patent is extended or adjusted under 35 U.S.C. 154(b) by 0 days.

(21) Appl. No.: 18/960,781

(22) Filed: Nov. 26, 2024

(65) Prior Publication Data

US 2025/0092587 A1 Mar. 20, 2025

Related U.S. Application Data

(63) Continuation-in-part of application No. 18/671,464, filed on May 22, 2024, now Pat. No. 12,247,333.

(60) Provisional application No. 63/470,284, filed on Jun. 1, 2023.

(51) Int. Cl.
*D04B 33/00* (2006.01)
*D04B 3/04* (2006.01)

(52) U.S. Cl.
CPC ..... *D04B 33/00* (2013.01); *D04B 3/04* (2013.01)

(58) Field of Classification Search
CPC ... D04B 3/04; D04B 3/06; D04B 3/00; D04B 5/00; D04B 39/00; D04B 33/00; D04B 36/00
USPC ..... 66/1 A, 1, 4
See application file for complete search history.

(56) References Cited

U.S. PATENT DOCUMENTS 248,669 A * 10/1881 Sackett ..... D04B 33/00 289/16.5
1,168,554 A * 1/1916 Riley ..... D04B 17/00 66/1 R
1,208,085 A * 12/1916 Branley ..... B65H 57/04 242/153
1,473,953 A * 11/1923 Dart ..... D05B 91/04 D3/29
2,072,668 A * 3/1937 Eltgroth ..... D04B 17/00 D15/66
2,142,608 A * 1/1939 Hockert ..... D04B 3/00 66/1 A
2,434,609 A * 1/1948 Coffey ..... D04B 3/00 43/25
2,524,157 A * 10/1950 Beirer ..... D04B 3/00 242/157 R
3,717,012 A * 2/1973 Misner ..... D04C 3/00 66/1 A (Continued)

*Primary Examiner* — Danny Worrell
(74) *Attorney, Agent, or Firm* — PATENTFILE, LLC; Bradley C. Fach; Steven R. Kick

(57) ABSTRACT

A crochet assistance apparatus may include an optional securement device, a base, a guide assembly, and a tensioner assembly. The securement device may be configured to be secured to a support object. The base may be coupled to the securement device, and the guide assembly may be coupled to the base. The guide assembly may include a distal guide surface and a proximal guide surface, and the distal guide surface may be positioned relatively farther from the base than the proximal guide surface. The tensioner assembly may be configured to receive the flexible filament, so that the flexible filament moves through the tensioner assembly and contacts one or more elements of the tensioner assembly. The tensioner assembly may have one or more filament contact surfaces, and the tensioner assembly may exert a resistance to the flexible filament moving through the tensioner assembly.

19 Claims, 6 Drawing Sheets

(56) References Cited

U.S. PATENT DOCUMENTS

| | | | | | |
|---|---|---|---|---|---|
| 3,875,878 | A * | 4/1975 | Kaminski | D05B 23/002 | 112/12 |
| 3,967,467 | A * | 7/1976 | Leach, Sr. | D04B 3/00 | 66/4 |
| 4,193,273 | A * | 3/1980 | Palange | D04B 39/00 | 66/4 |
| 4,362,032 | A * | 12/1982 | Palange | D04B 39/00 | 66/4 |
| 4,370,870 | A * | 2/1983 | Kroh | D04B 3/00 | 66/1 A |
| 4,393,668 | A * | 7/1983 | Leach, Sr. | D04B 5/00 | 66/4 |
| 4,635,834 | A * | 1/1987 | Lindquist | D04B 3/06 | 242/146 |
| 6,449,987 | B1 * | 9/2002 | Poole | D04B 3/00 | 66/1 A |
| 11,851,791 | B2 * | 12/2023 | Thorsen | D04B 3/04 | |
| 2012/0047960 | A1 * | 3/2012 | Sasur | D04B 3/00 | 66/1 A |
| 2023/0183895 | A1 * | 6/2023 | Thorsen | D04B 3/04 | 66/1 A |

* cited by examiner

CROCHET ASSISTANCE APPARATUS

CROSS REFERENCE TO RELATED APPLICATIONS

This application is a continuation-in-part of U.S. Non-Provisional application Ser. No. 18/671,464, filed on May 22, 2024, entitled "CROCHET ASSISTANCE APPARATUS", which claims the benefit of U.S. Provisional Patent Application No. 63/470,284, filed on Jun. 1, 2023, entitled "CROCHET ASSIST APPARATUS", the entire disclosures of which are incorporated by reference herein.

FIELD OF THE INVENTION

This patent specification relates to the field of crocheting yarn or other malleable filaments. More specifically, this patent specification relates to a crochet assistance apparatus which enables an individual with movement deficiency in a body part or extremity, e.g., fingers, hands, arms, shoulder, etc., to be able to crochet with pace and accuracy to make the activity enjoyable and fruitful.

BACKGROUND

Crocheting is a very specific art of manipulating yarn and other flexible filaments into various knotted patterns to produce a stretch of material which can be used for clothing, blankets, holders, cloth coverings, or any other product the imagination produces. The various knotted patterns are known as crochet stitches. A row is a series of numbered stitches. Once a crocheter reaches the end of the row, i.e., completes a desired number of stitches, some products are reversed, i.e., flipped direction, and the "next" row is started on the reverse side to create stitches that are unique to crocheting. Other products will continue in a contiguous line or circular pattern to create stitches that are unique to crocheting. This pattern is repeated until the desired number of rows is achieved. Crocheting differs from knitting and other yarn and flexible filament manipulating arts as crocheting is performed with two human hands, a bundle of yarn, and a crochet needle. Each hand has very specific tasks while crocheting. Because crocheting can be performed by either a "right" handed or "left" handed artist the terms "yarn hand" and "needle hand" will allow for ambidextrous nomenclature. This is not to imply that a crocheter could simply switch tasks between hands. Switching the yarn hand with the needle hand or vice versa is as practical as switching which hand one writes with. The needle hand holds a crochet needle, a long handheld cylindrical tool of various thickness with a hook at one end which will aid in manipulating the yarn or other malleable filament into various knotted patterns. The yarn hand provides structure, support, and guidance from the bundle of yarn to the completed product. The yarn hand must provide exacting structure, support, and guidance by fashioning the human fingers into various structures. These various structures require agility, dexterity, stamina, and proper human hand/finger placement knowledge to create the knotted patterns at a pace which makes crocheting an enjoyable task. The yarn hand must 1) hold the completed structure in a usable position, 2) provide support of the yarn for the needle to penetrate the next stitch, and 3) provide yarn guidance so the needle may have the appropriate approach for attack.

Due to illness, injury, or other maladies, one may find their ability to use their needle hand or their yarn hand diminished. At current, there are obvious and existing techniques that will aid those with needle hand deficiencies. Using a simple heavy structure in which a crochet needle is fastened, the artist will use the yarn hand to manipulate the yarn around the statically held needle.

There does not exist an aid, apparatus, structure, or technique that can help those with yarn hand deficiencies. The complexity of tasks the yarn hand must perform simultaneously requires an apparatus that provides 1) structure, 2) support, and 3) guidance with an easy-to-use interface. Beginning crocheters have a steep learning curve to develop the agility, dexterity, stamina, and proper hand/finger placement knowledge of their yarn hand to properly crochet with ease and enjoyment. Existing crocheters may see a decrease in agility, dexterity, or stamina in their hands over time. This is an effort to allow new and existing crocheters the ability to begin or continue their desire to crochet for whatever reason they may have.

My mother, Leticia, is left side hemiplegic due to a stroke and lost the ability to crochet, among other activities. My mother lost one-hundred percent ability to use her yarn hand. My mother has a longing towards enjoying this art again to some degree. I promised her I would attempt to create an apparatus that could help her. I taught myself how to crochet and this apparatus is an effort to allow my mother and others to gain some independence and enjoyment in this art lost to illness, injury, or other maladies.

Therefore, a need exists for novel crochet assistance apparatuses. A further need exists for novel crochet assistance apparatuses which enables a user to crochet and perform like activities to gain some independence and enjoyment in this art that may have been otherwise lost to illness, injury, or other maladies.

BRIEF SUMMARY OF THE INVENTION

A crochet assistance apparatus for supporting a flexible filament is provided which enables a user to crochet and perform like activities to gain some independence and enjoyment in this art that may have been otherwise lost to illness, injury, or other maladies. Preferably, the apparatus may perform one or more, such as all, the functions of a user's "yarn hand" during the performance of crochet and other flexible filament manipulating activities.

In some embodiments, the apparatus may include a base, a guide assembly, and a tensioner assembly. Optionally, the apparatus may include a securement device that may be configured to be secured to a plurality of support objects that may include a solid structure, such as a table, wall, etc., a portion of a user's body, such as their hand, wrist, arm, etc., or other type of object. The base may be coupled to the securement device, and the guide assembly may be coupled to the base. The guide assembly may include a guide hook having a distal guide surface and a proximal guide surface, and the distal guide surface may be positioned relatively farther from the base than the proximal guide surface. The tensioner assembly may be configured to receive the flexible filament, so that the flexible filament moves through the tensioner assembly and contacts one or more elements of the tensioner assembly. The tensioner assembly may have a first filament contact surface, a second filament contact surface, and a third filament contact surface, and the tensioner assembly may exert a resistance or tension to the flexible filament moving through the tensioner assembly. In use, a flexible filament may be moved through the tensioner assembly, across the proximal guide surface, and into contact with one or both of the user's hands as they form the flexible filament into a working product. The guide assembly functions to keep the flexible filament that is progressing towards the user's hands and working product above and out of the way of the user's needle hand, while the tensioner assembly maintains a desired resistance or tension to the flexible filament's movement to generate an appropriate amount of tension for the attacking needle.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
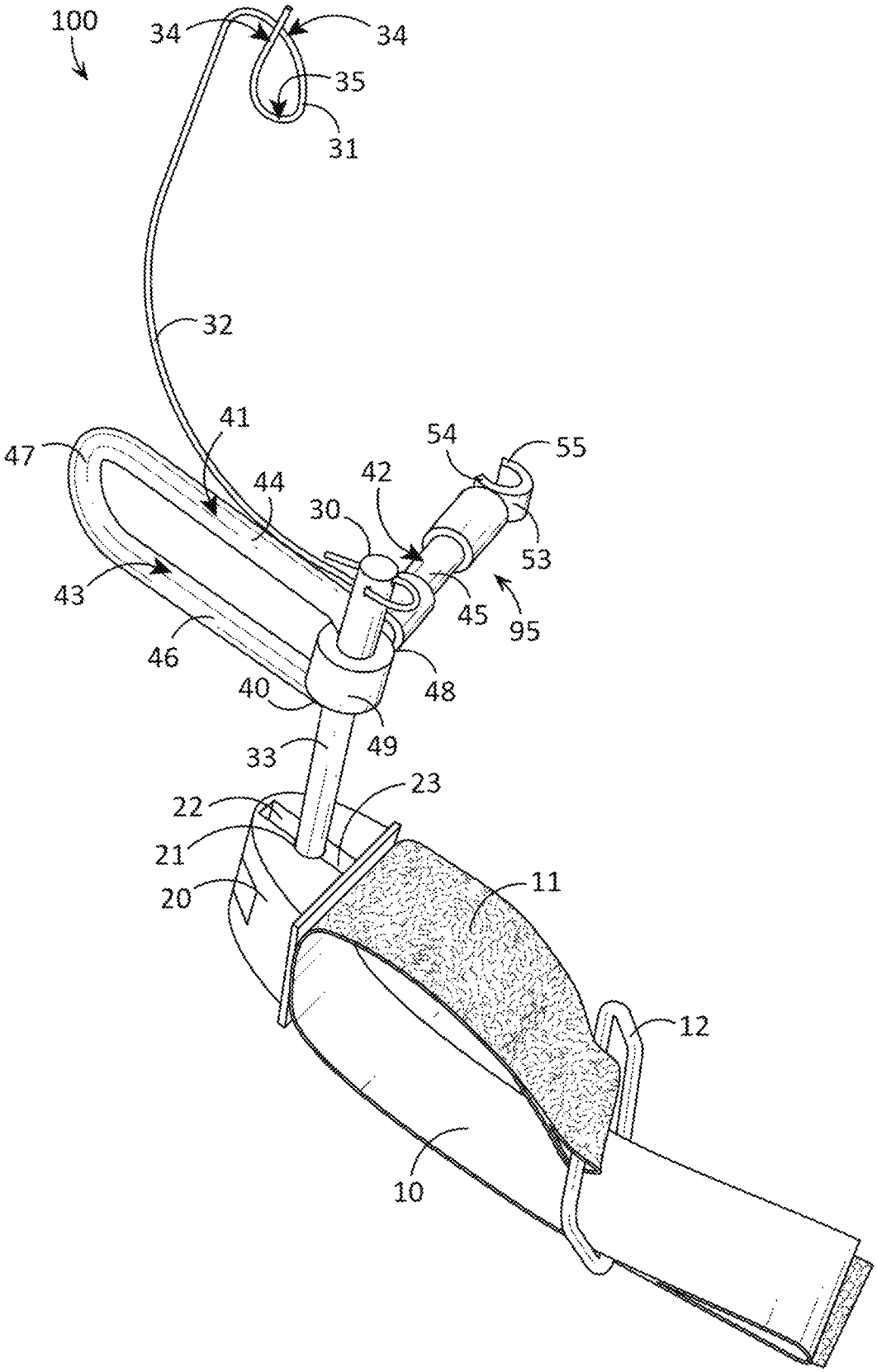
FIG. 1 depicts a top perspective view of an example of a crochet assistance apparatus according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 20% of the specified number. Additionally, as used in this application, the term "substantially" means that the actual value is within about 10% of the actual desired value, more preferably within about 5% of the actual desired value and even more preferably within about 1% of the actual desired value of any variable, element or limit set forth herein.

A new crochet assistance apparatus is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

Figure 6:
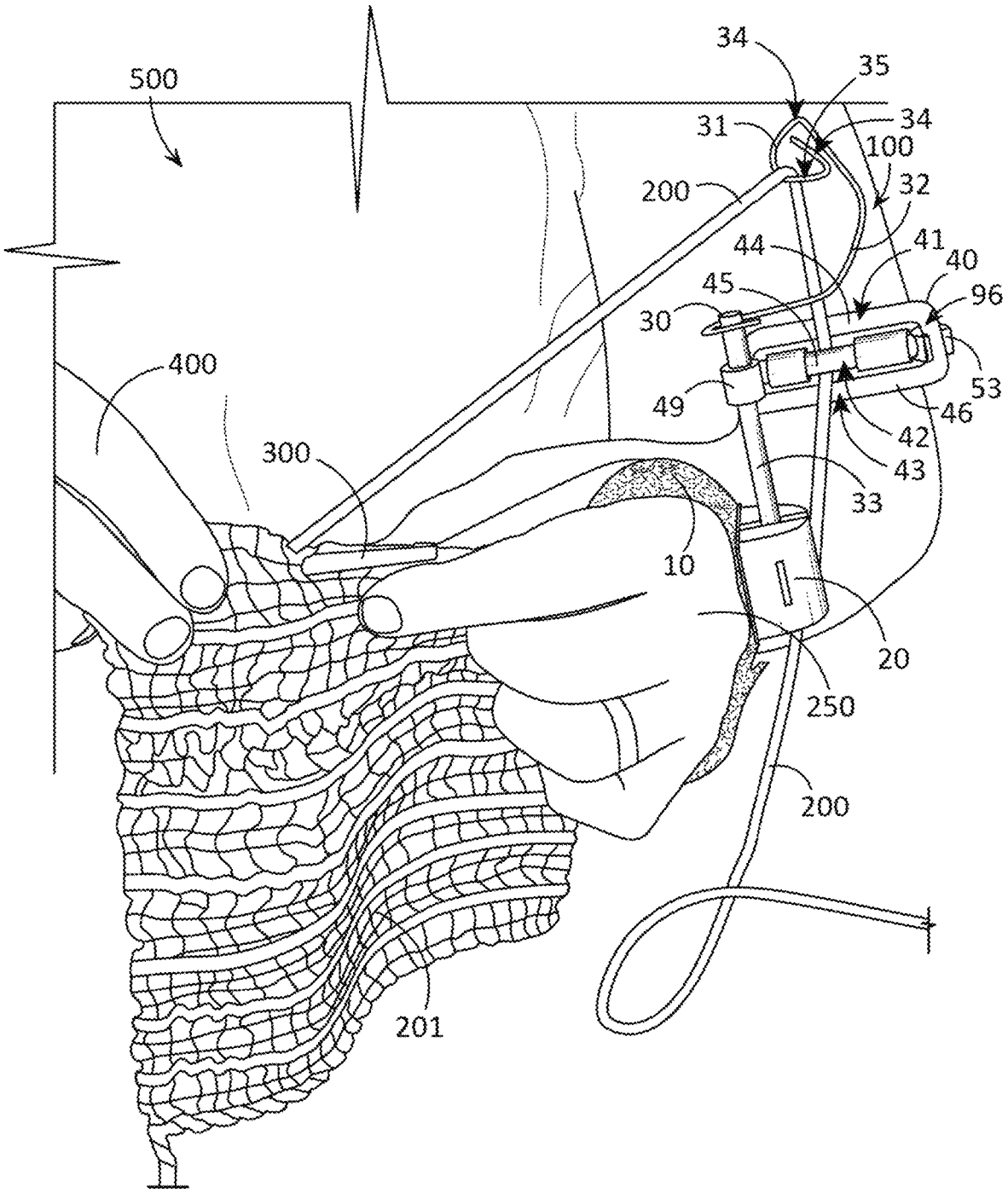
FIG. 6 shows a top front perspective view of an example of a crochet assistance apparatus being used to turn a flexible filament into a working or crocheted product according to various embodiments described herein.

The present invention will now be described by example and through referencing the appended figures representing preferred and alternative embodiments. FIGS. 1, 2, 3, and 6 illustrate examples of a crochet assistance apparatus ("the apparatus") 100 according to various embodiments. The apparatus 100 may be used to support a flexible filament 200 to facilitate a user's 500 ability to manipulate the flexible filament 200, such as for performing crochet activities. Preferably, the apparatus 100 may perform one or more, such as all, the functions of a user's "yarn hand" during the performance of crochet and other flexible filament 200 manipulating activities. In some embodiments, the apparatus 100 may comprise a securement device 10, a base 20, a guide assembly 30, and a tensioner assembly 40. The securement device 10 may be configured to be secured to a support object 250. A support object 250 may comprise any object that may support the weight of the apparatus 100, such as: a portion of a user's 500 body, such as their hand (as shown in FIG. 6), wrist, arm, etc.; a solid structure, such as a table, wall, etc.; or other type of object. The base 20 may be coupled to the securement device 10, and the guide assembly 30 may be coupled to the base 20. The guide assembly 30 may include a guide hook 31 having a distal guide surface 34 and a proximal guide surface 35, and the distal guide surface 34 may be positioned relatively farther from the base 20 than the proximal guide surface 35. The tensioner assembly 40 may be configured to receive the flexible filament 200, so that the flexible filament 200 moves through the tensioner assembly 40 and contacts one or more elements of the tensioner assembly 40. The tensioner assembly 40 may have a first filament contact surface 41, a second filament contact surface 42, and a third filament contact surface 43, and the tensioner assembly 40 may exert a resistance or tension to the flexible filament 200 moving through the tensioner assembly 40. In use, a flexible filament 200 may be moved through the tensioner assembly 40, across the proximal guide surface 35, and into contact with one or both of the user's hands as they form the flexible filament 200 into a working product 201. The guide assembly 30 functions to keep the flexible filament 200 that is progressing towards the user's hands and working product 201 above and out of the way of the user's needle hand 400 or mechanical device that is configured to perform a similar function, such as a machine that moves a needle instead of a person's hand, while the tensioner assembly 40 maintains a desired resistance or tension to the flexible filament's 200 movement to generate an appropriate amount of tension for the attacking needle 300.

The apparatus 100 may optionally comprise a securement device 10 that may be configured to be secured to a plurality of support objects 250. A support object 250 may comprise any object that may support the weight of the apparatus 100, such as: a portion of a user's body 500, such as around the palm of a user's hand (as shown in FIG. 6), around a user's wrist, around a user's arm, etc.; a solid structure, such as a table, wall, etc.; or other type of object. In some embodiments, a securement device 10 may be made from or may comprise a flexible material that may conform to the shape of the support object 250 around which the securement device 10 is positioned. Example, flexible materials may include polypropylene webbing, polyester webbing, various types of flexible plastics such as polyvinyl chloride, natural rubber, neoprene form rubber, synthetic rubber material such as latex rubber, forms of the organic compound isoprene, Polyacrylate Rubber, Ethylene-acrylate Rubber, Polyester Urethane, a flexible plastic such as high-density polyethylene (HDPE), polyvinyl chloride (PVC), polypropylene (PP), Polystyrene (PS), Polycarbonate (PC), low density polyethylene (LDPE), synthetic fabrics such as polyester, nylon, rayon, acetate, spandex, spandex blends, and Kevlar, and natural fabrics such as coir, cotton, hemp, jute, canvas, flax, leather, linen, ramie, wool, silk, or any other flexible material.

In preferred embodiments, and in its simplest form, a securement device 10 may be made from an elongated strap of flexible material, such as rope, nylon webbing, leather strap, or the like, which may be positioned around a portion of a support object 250. For example, a securement device 10 may be made from an elongated strap of flexible material which may be positioned around a portion of a support object 250 that may be the body of a user 500, such as around their palm as shown in FIG. 6. As another example, a flexible user securement device 10 may be made from an elongated strap of flexible material which may be positioned around a portion of a support object 250 that may be a solid structure, such as a table, wall, lamp, etc. In further embodiments, a securement device 10 may comprise a glove, full fingered glove, open finger(s) glove, mitten, or the like which may cover and receive all or portions of a user's hand. In further embodiments, a securement device 10 may be configured as a sleeve, harness, or other arrangement of flexible material which may be removably coupled or engaged to a desired portion of a support object 250. In still further embodiments, a securement device 10 may comprise a substantially rigid material, such as steel alloys, aluminum, aluminum alloys, copper alloys, other types of metal or metal alloys, ceramics such as alumina, porcelain, and boron carbide, earthenware, natural stone, synthetic stone, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid and suitable for securing a base 20 to a support object 250. In still further embodiments, a securement device 10 may comprise a magnetic type fastener, threaded type fastener, sealable tongue and groove fastener, snap fastener, clip type fastener, clasp type fastener, ratchet type fastener, a push-to-lock type connection method, a turn-to-lock type connection method, a slide-to-lock type connection method or any other suitable temporary connection method as one reasonably skilled in the art could envision to serve the same function of coupling the base 20 to a support object 250.

In some embodiments, the securement device 10 may comprise a hook and loop fastener 11 (having a hook portion 11A and a loop portion 11B) which may be used to couple the securement device 10 around a desired portion of a support object 250. In preferred embodiments, the securement device 10 may comprise an elongated strap of flexible material, such as a fabric strap, to which a hook and loop fastener 11 may be coupled.

In further preferred embodiments, the apparatus 100 may comprise a fastener ring 12 which may be coupled to the securement device 10, such as to one end of an elongated strap of flexible material that may form the securement device 10. Fastener rings 12 may include buckles, clasps, slides, loops, reducers, cam buckles, strap adjusters, snap hooks, D rings, tri-loops, footman loops, keepers, cord locks, strap locks, or any other suitable means for adjusting the length of the securement device 10 by inserting a portion of the securement device 10 through a fastener ring 12.

The apparatus 100 may comprise a base 20 that may be coupled to the securement device 10 and which may be configured to couple the guide assembly 30 and tensioner assembly 40 to the securement device 10. A base 20 may be configured in any size and shape. Generally, a base 20 may comprise a preferably rigid structure which the support beam 33 of the guide assembly 30 may be coupled, such as a block or other shape of material. In some embodiments, a base 20 may be made from or may comprise a substantially rigid material, such as aluminum, aluminum alloys, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid.

A base 20 may be coupled to the securement device 10 via any suitable coupling method. For example, a base 20 may be coupled to the securement device 10 via adhesive, heat bonding, via fasteners such as rivets, threaded fasteners, etc., by inserting a portion of the securement device 10 through one or more apertures in the base, or any other suitable coupling method.

In preferred embodiments, a support beam 33 of a guide assembly 30 may be coupled to the base 20 thereby coupling the guide assembly 30 to the base 20, and the tensioner assembly 40 may also be coupled to the support beam 33. A support beam 33 may be coupled to the base 20 via any suitable coupling method. For example, a support beam 33 may be coupled to the base 20 via adhesive, heat bonding, via fasteners such as rivets, threaded fasteners, etc., by inserting a portion of the securement device 10 through one or more apertures in the base, etc.

In preferred embodiments, the support beam 33 may be movably coupled and removably coupled to the base 20 so that the support beam 33 may be movable relative to the base 20 and removable from the base 20. In some embodiments, the support beam 33 may be movably coupled to the base 20 by having the support beam 33 and base pivotally coupled together so that the support beam 33 may be rotated relative to the base 20. For example, the base 20 may comprise a cylindrical shaped central aperture 21 with two or more opposingly positioned cutouts 22, 23, and the support beam 33 may comprise a cylindrical bottom end 36 having two or more opposingly positioned beam projections 37, 38, and the bottom end 36 may be inserted into the central aperture 21 with the beam projections 37, 38, inserted into the cutouts 22, 23, so that when the support beam 33 is rotated between five and 175 degrees the beam projections 37, 38, may be unaligned from the cutouts 22, 23, while remaining in the base 20 and functioning to retain the bottom end 36 within the base 20. Once the support beam 33 is pivoted or rotated to align the beam projections 37, 38, with the cutouts 22, 23, the bottom end 36 may be removed from the base 20. In further embodiments, the support beam 33 may be movably coupled to the base 20 via a ball joint coupling method. In further embodiments, the support beam 33 may be movably coupled and/or removably coupled to the base 20 via threaded fasteners, magnetic fasteners, or via any other suitable movable and/or removable coupling method.

The apparatus 100 may comprise a guide assembly 30 that may be configured in any shape and size. Preferably, a guide assembly 30 may comprise a guide hook 31 having one or more distal guide surfaces 34 and one or more proximal guide surfaces 35, and the distal guide surfaces 34 may be positioned relatively farther from the base 20 than the proximal guide surfaces 35. Preferably, a guide assembly 30 may comprise a guide hook 31 having one or more distal guide surfaces 34 and one or more proximal guide surfaces 35 that may extend above the tensioner assembly 40 when the tensioner assembly 40 is coupled to the guide assembly 30. Distal guide surfaces 34 and proximal guide surfaces 35 may be formed on a guide hook 31. Generally, a proximal guide surface 35 may be positioned between two distal guide surfaces 34, and the relatively higher distal guide surfaces 34 may guide and direct the flexible filament 200 to stay between the relatively higher distal guide surfaces 34 and in contact with the relatively lower proximal guide surface 35 positioned between the distal guide surfaces 34. For example, a guide hook 31 may have a proximal guide surface 35 positioned between two distal guide surfaces 34 by being configured as a loop (FIGS. 1 and 6), a U-shaped or W-shaped structure (FIGS. 2 and 3), a hook (FIGS. 4 and 5), or any other structure, preferably having a proximal guide surface 35 positioned between two distal guide surfaces 34.

A guide body 32 and a guide hook 31 may be configured in any size and shape. For example, a guide body 32 and a guide hook 31 may comprise a length of metal wire, a wire with a loop, twisted channel, a small loop or spiral of material, other hollow structure plastic filament, or other object into or onto which one or more distal guide surfaces 34 and one or more proximal guide surfaces 35 be formed. Distal guide surfaces 34 and proximal guide surfaces 35 may be configured in any size and shape. Preferably, a guide hook 31 may comprise a proximal guide surface 35 that may be configured as a U-shaped surface between two distal guide surfaces 34 across which a flexible filament 200 may move. Optionally, a guide body 32 may form a conduit, channel, or other conducting configuration which may have a relatively lower (positioned closer to base 20) proximal guide surface 35 and a relatively higher (positioned farther from base 20) distal guide surface 34.

In some embodiments, a guide assembly 30 may comprise a support beam 33 which may be coupled to the guide body 32 and which may couple the other elements of the guide assembly 30 to the base 20. A support beam 33 may be configured in any size and shape. Preferably, a support beam 33 may comprise an elongated length of substantially rigid material having a bottom end 36 with one or more beam projections 37, 38, coupled there to and a top end 39 to which the guide body 32 may be coupled. Preferably, a tensioner assembly may be coupled to the support beam 33 between the ends 36, 39.

Generally, a guide assembly 30 may be used to provide guidance for the flexible filament 200 that is being directed or supplied to the hands of a user 500 to have the proper angle for the attacking needle 300. The guide assembly 30 may replace or function as the outstretched user finger that holds the yarn or other flexible filament 200 at the proper angle for the attacking needle 300.

In some embodiments, the apparatus 100 may comprise one or more tensioner assemblies 40 that may be coupled, such as by being removably coupled, to an element of the apparatus 100. In preferred embodiments, a tensioner assembly 40 may be coupled to the support beam 33 of a guide assembly 30. Generally, a tensioner assembly 40 may be configured to control the tension of the flexible filament 200 as it moves towards and across a proximal guide surface 35 of the guide assembly 30 so that the flexible filament 200 is not too slack or too tight for the user 500 to add the flexible filament 200 to the working product 201 in a series of stitches. While crocheting, the user 500 will usually wrap the yarn or other flexible filament 200 around their fingers to control how much tension the flexible filament 200 has. Too much tension and the flexible filament 200 will pull the previous stitches apart, too little tension and the needle 300 will not be able to make the appropriate loop or pull.

A tensioner assembly 40 may be configured to receive the flexible filament 200 so that the flexible filament 200 moves between at least two elements of the tensioner assembly 40, such as between two or more filament contact surfaces 41, 42, 43. In some embodiments, and the tensioner assembly 40 may have a first filament contact surface 41, a second filament contact surface 42, and a third filament contact surface 43, and the tensioner assembly 40 may exert a resistance to the flexible filament 200 moving through the tensioner assembly 40 by exerting a resistance to the movement of the flexible filament 200 through the tensioner assembly 40.

In preferred embodiments, as the flexible filament 200 moves through the tensioner assembly 40, the flexible filament 200 may contact and move across two or more filament contact surfaces 41, 42, 43, so that the tensioner assembly 40 may impart a frictional resistance to movement of the flexible filament 200 through the tensioner assembly 40. In further preferred embodiments, the flexible filament 200 may move across (so as to contact) the first filament contact surface 41, across the second filament contact surface 42, and across the third filament contact surface 43 as the flexible filament 200 moves through the tensioner assembly 40, and the contact of the flexible filament 200 with the filament contact surfaces 41, 42, 43, may impart a frictional resistance to movement of the flexible filament 200 through the tensioner assembly 40.

The filament contact surfaces 41, 42, 43, of a tensioner assembly 40 may be configured in any shape and size. In some embodiments, a tensioner assembly 40 may comprise one or more generally cylindrical shaped, or other elongated shaped, rods or bars that the one or more filament contact surfaces 41, 42, 43, may be formed or disposed on. In preferred embodiments, a tensioner assembly 40 may comprise a first stabilizing rod 44, a central rod 45, and a second stabilizing rod 46, and the first filament contact surface 41 may be disposed on the first stabilizing rod 44, the second filament contact surface 42 may be disposed on the central rod 45, and the third filament contact surface 43 may be disposed on the second stabilizing rod 46. In some embodiments, a first filament contact surface 41 may be disposed on the first stabilizing rod 44 by being recessed or depressed into the first stabilizing rod 44 (e.g., configured as a recessed channel on the first stabilizing rod 44), the second filament contact surface 42 may be disposed on the central rod 45 by being recessed or depressed into the central rod 45 (e.g., configured as a recessed channel on the central rod 45), and/or the third filament contact surface 43 may be disposed on the second stabilizing rod 46 by being recessed or depressed into the second stabilizing rod 46 (e.g., configured as a recessed channel on the second stabilizing rod 46) so that the flexible filament 200 may wrap around a portion of the rods 44, 45, 46, in a serpentine fashion as the path for the flexible filament 200 to travel through the tensioner assembly 40. In some embodiments, a tensioner assembly 40 may comprise a first stabilizing rod 44 and a second stabilizing rod 46 that may be configured as two generally smooth cylindrical bars and one a central rod 45 preferably having a recessed channel into which the flexible filament 200 may move through so that the flexible filament 200 may wrap around a portion of the rods 44, 45, 46, in a serpentine fashion as the path for the flexible filament 200 to travel through the tensioner assembly 40. In some embodiments, the central rod 45 and its second filament contact surface 42 (optionally configured as a recessed channel on the central rod 45) may be configured with variable thicknesses or sizes to accommodate different flexible filament 200 thickness and to exert varying amounts of tension on the flexible filament 200. For example, a relatively thicker central rod 45 or wider second filament contact surface 42 may exert relatively more tension on a flexible filament 200 as it moves across it (and thereby exert relatively more frictional resistance to movement of the flexible filament 200 through the tensioner assembly 40) and/or accommodate relatively thinner flexible filaments 200, while a relatively thinner central rod 45 or narrower second filament contact surface 42 may exert relatively less tension on a flexible filament 200 as it moves across it (and thereby exert relatively less frictional resistance to movement of the flexible filament 200 through the tensioner assembly 40) and/or accommodate relatively thicker flexible filaments 200 Optionally, one or more of the filament contact surfaces 41, 42, 43, and rods 44, 45, 46, may be elongated in a linear manner.

In some embodiments, the apparatus 100 may include a central rod 45 that may be movably coupled to another element of the apparatus 100 so that all or portions of the central rod 45 may be movable relative to one or both of the stabilizing rods 44, 46. In preferred embodiments, a central rod 45 may be movably coupled, directly or indirectly, to a support beam 33 via a movable coupling 49. Preferably, a movable coupling 49 may comprise a substantially rigid material that may be formed to partially or completely encircle a cylindrical shaped support beam 33 so that the movable coupling 49 may pivot or rotate around the support beam 33. In some embodiments, a movable coupling 49 may comprise a hinged coupling such as butt hinge, butterfly hinge, flush hinge, barrel hinge, concealed hinge, continuous hinge, T-hinge, strap hinge, double-acting hinge, Soss hinge, a flexible material hinge, or any other hinge. In still further embodiments, a movable coupling 49 may comprise a pivotal or rotating coupling such as a rivet, bearing, knuckle joint, universal joint, male ball joint and female socket joint, or any other pivotal or rotating coupling, or any other method of movably coupling two objects together so that one object may be moved, pivoted, rotated, or the like, relative to the other object.

In some embodiments and as perhaps best shown in FIGS. 1-4, a central rod 45 may comprise a first end 51 and a second end 52, and the first end 51 may be coupled to a movable coupling 49 and the second end 52 may comprise a retainer 53. Generally, a retainer 53 may be configured to removably couple the second end 52 to a tensioner brace 47. In preferred embodiments, the tensioner assembly 40 may comprise a tensioner brace 47, and the first stabilizing rod 44 and the second stabilizing rod 46 may both be coupled to the tensioner brace 47. The central rod 45 may comprise a first end 51 and a second end 52, and the first end 51 may be pivotally coupled to the support beam 33 via a movable coupling 49, and the second end 52 may be removably coupled to the tensioner brace 47 via a retainer 53.

Figure 2:
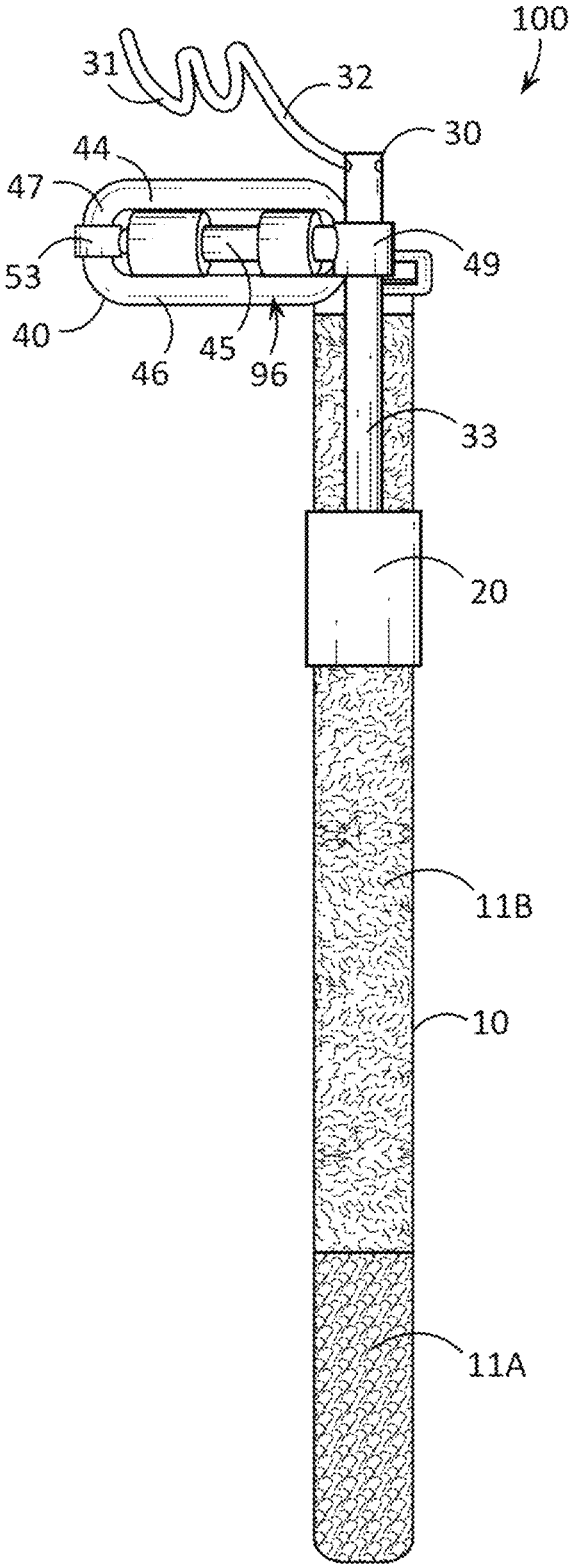
FIG. 2 illustrates a front elevation view of another example of a crochet assistance apparatus according to various embodiments described herein.
Figure 3:
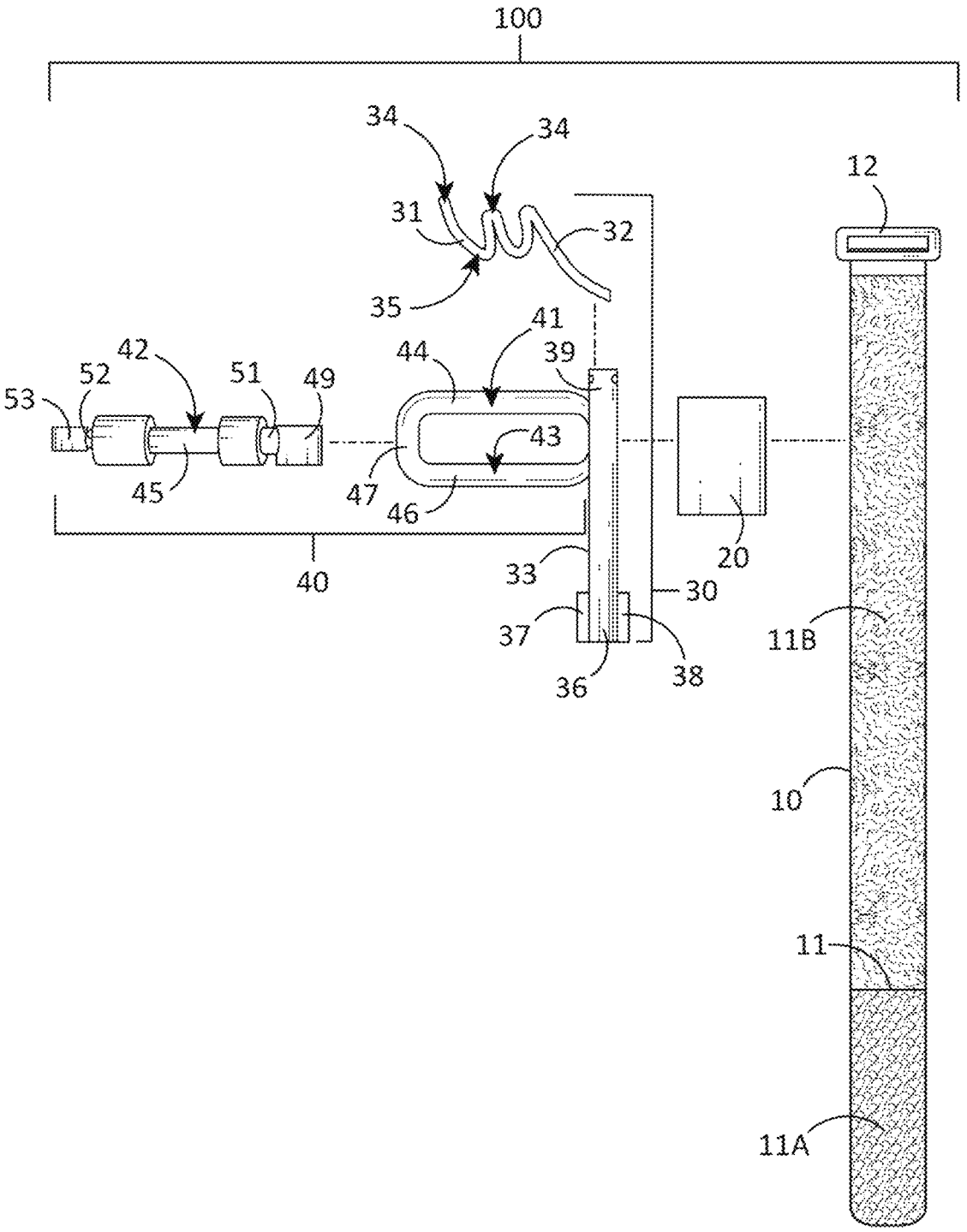
FIG. 3 shows a front, exploded elevation view of another example of a crochet assistance apparatus according to various embodiments described herein.

In some embodiments, a retainer 53 may be configured to be frictionally coupled to the tensioner brace 47 so that the retainer 53 may be press fit on to and off of the tensioner brace 47. For example, a retainer 53 may comprise two flexible arms 54, 55, that may be sized to partially encircle the tensioner brace 47 and the retainer 53 may be frictionally coupled to the tensioner brace 47 by pressing the tensioner brace 47 between the two arms 54, 55, until the arms 54, 55, partially encircle the tensioner brace 47, and then uncoupled from the retainer 53 by pressing the tensioner brace 47 out from between the two arms 54, 55. While the tensioner brace 47 is between the arms 54, 55, the arms 54, 55, may be flexed apart thereby providing a frictional resistance to coupling and uncoupling the retainer 53 to the tensioner brace 47. In further embodiments, a retainer 53 may be removably coupled to the tensioner brace 47 by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function In some embodiments and as perhaps best show in FIGS. 1-5, a central rod 45 may be movably coupled to the support beam 33 via a movable coupling 49 that may enable the central rod 45 to be movable relative to one or both of the stabilizing rods 44, 46, such as between an open position 95 (FIGS. 1 and 4) and a closed position 96 (FIGS. 2, 5, and 6). In some embodiments, the tensioner assembly 40 may comprise a tensioner brace 47 that may be coupled to the stabilizing rods 44, 46, such as by being integrally formed together, and the stabilizing rods 44, 46, may also be coupled to the support beam 33. The central rod 45 may be movably coupled the support beam 33 via a movable coupling 49, so that the support beam 33 may form an axis that the movable coupling 49 may pivot around (e.g., the support beam 33 may function as an axle and the movable coupling 49 may function as a bearing) to allow the central rod 45 to be movable relative to one or both of the stabilizing rods 44, 46. For example, a movable coupling 49 may encircle the support beam 33 while allowing the movable coupling 49 to pivot or rotate around the support beam 33. In some embodiments, the central rod 45 may be movably coupled to the support beam 33 via movable coupling 49 so that the central rod 45 may be pivotable between the open position 95 and the closed position 96.

Figure 4:
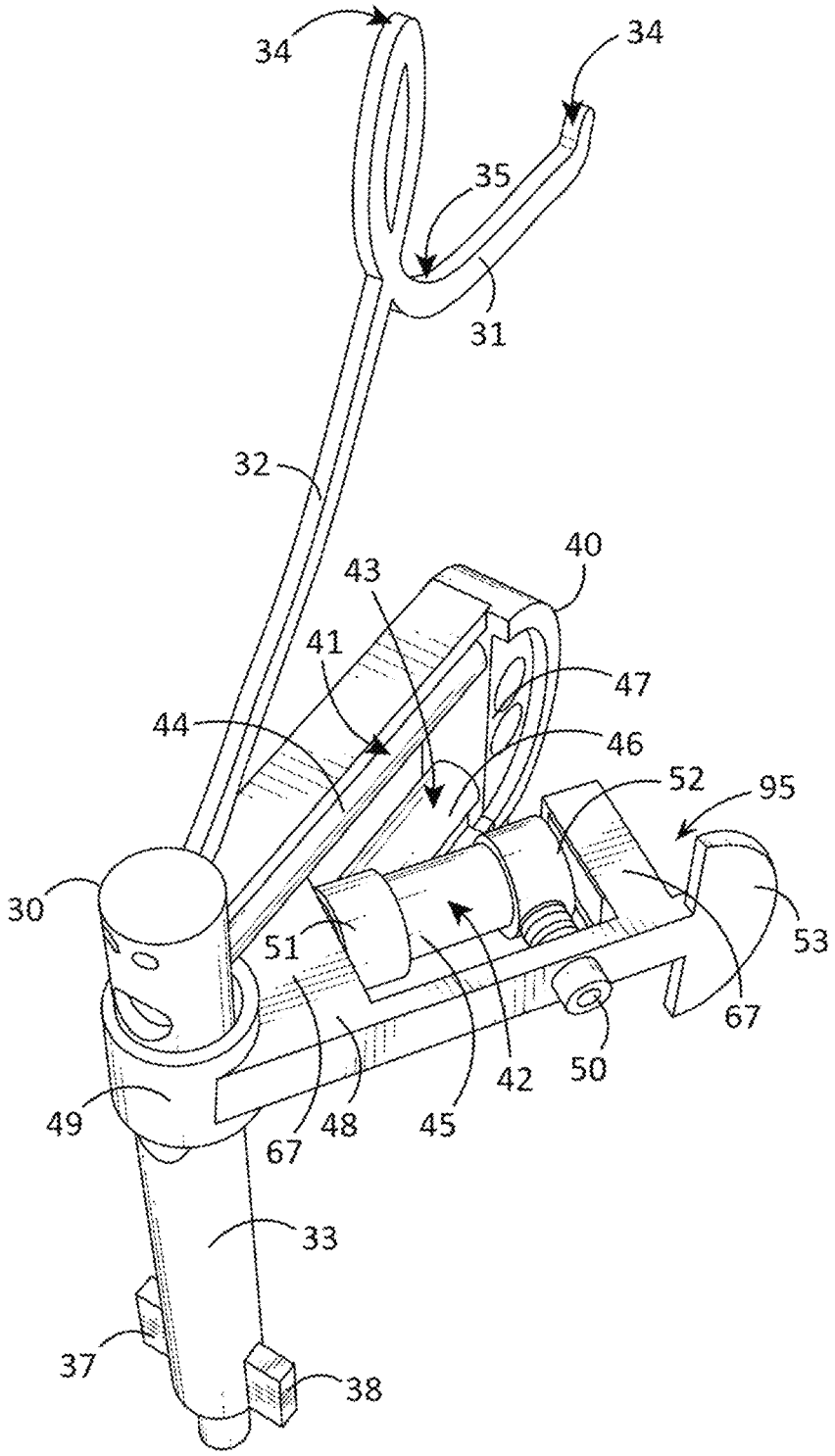
FIG. 4 depicts a top perspective view of a further example of a guide assembly and tensioner assembly in an open position according to various embodiments described herein.
Figure 5:
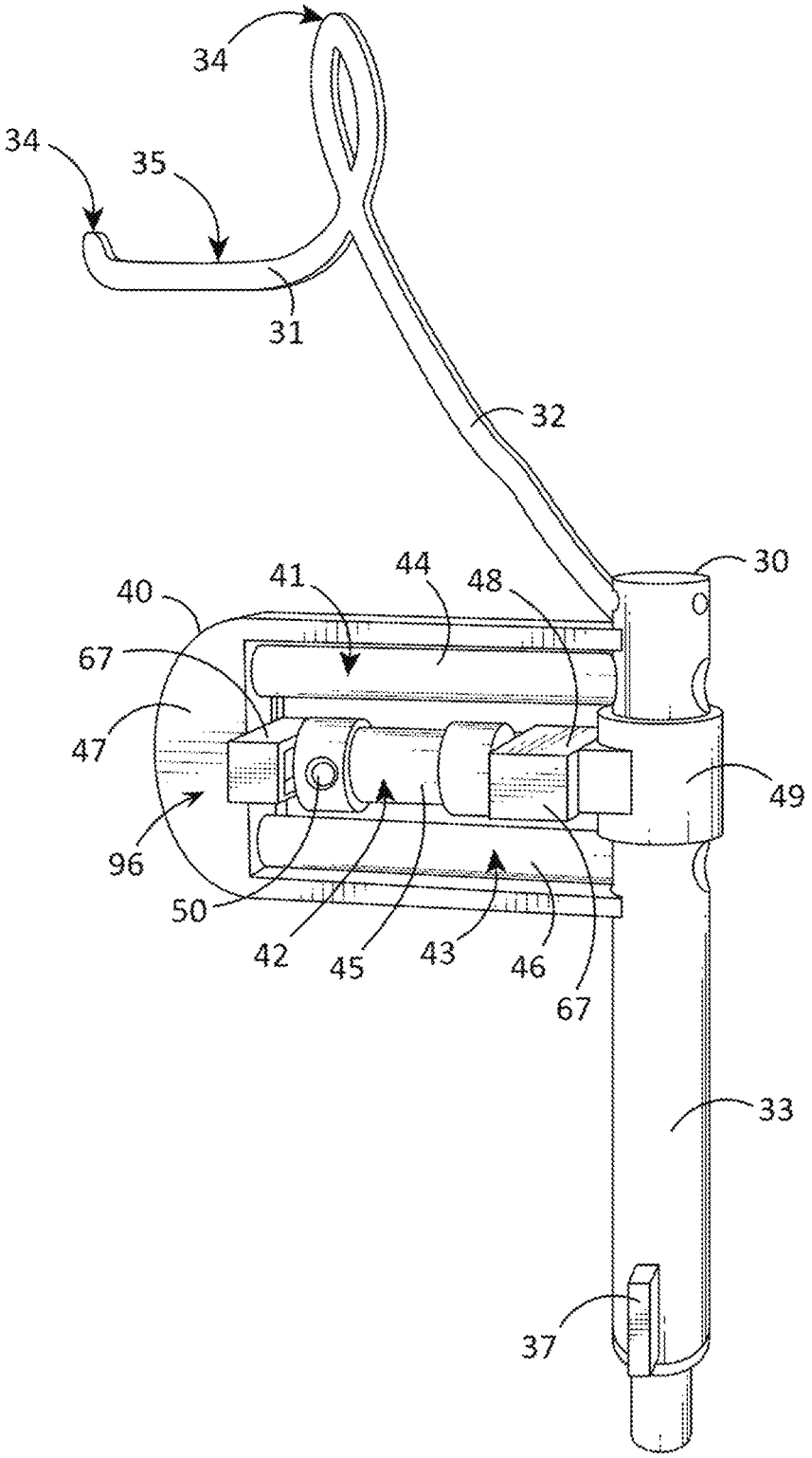
FIG. 5 illustrates a top perspective view a further example of a guide assembly and tensioner assembly in a closed position according to various embodiments described herein.

In some embodiments and as perhaps best show in FIGS. 4 and 5, a central rod 45 may be coupled to a tensioner swing arm 48 and the tensioner swing arm 48 may be movably coupled to the support beam 33 via a movable coupling 49 that may enable the central rod 45 to be movable relative to one or both of the stabilizing rods 44, 46. In some embodiments, the tensioner assembly 40 may comprise a tensioner brace 47 and the stabilizing rods 44, 46, may be coupled to the tensioner brace 47 and to the support beam 33. The central rod 45 may be movably coupled to the tensioner brace 47 and/or movably coupled to the support beam 33 via a movable coupling 49, so that the support beam 33 may form an axis that the movable coupling 49 may pivot around (e.g., the support beam 33 may function as an axle and the movable coupling 49 may function as a bearing) to allow the tensioner swing arm 48 and the central rod 45 that is coupled to it to be movable relative to one or both of the stabilizing rods 44, 46. For example, a movable coupling 49 may encircle the support beam 33 while allowing the movable coupling 49 to pivot or rotate around the support beam 33. In some embodiments, the central rod 45 may be movably coupled to the support beam 33 by being coupled to a tensioner swing arm 48 that is coupled to the support beam 33 via a movable coupling 49 so that the central rod 45 and tensioner swing arm 48 may be pivotable between the open position 95 and the closed position 96. Preferably, the tensioner swing arm 48 may be removably coupled to the tensioner brace 47 via a retainer 53.

Preferably, the central rod 45 may be movable between an open position 95, in which only one end of the tensioner swing arm 48 may be coupled (directly or indirectly via arm braces 67) to the support beam 33 (FIG. 4), and a closed position 96, in which one end of the tensioner swing arm 48 may be coupled to the support beam 33 and the other end of the tensioner swing arm 48 may be coupled (directly or indirectly via arm braces 67) to the tensioner brace 47 (FIG. 5). In some embodiments, the central rod 45 may be positioned between the first stabilizing rod 44 and the second stabilizing rod 46 when the central rod 45 is in the closed position 96.

Preferably, one or more of the filament contact surfaces 41, 42, 43, and rods 44, 45, 46, may be elongated in a linear manner. In some embodiments, the central rod 45 may be movable between an open position 95 and a closed position 96, in which the central rod 45 may be substantially a parallel (plus or minus 5 degrees) to the one of the first stabilizing rod 44 and the second stabilizing rod 46 when in the closed position 96, and in which the central rod 45 may be substantially not parallel to the one of the first stabilizing rod 44 and the second stabilizing rod 46 when in the open position 95. In further embodiments, the central rod 45 may be movable between an open position 95 and a closed position 96, in which the central rod 45 may be substantially a parallel (plus or minus 5 degrees) to both of the first stabilizing rod 44 and the second stabilizing rod 46 when in the closed position 96, and in which the central rod 45 may be substantially not parallel to both of the first stabilizing rod 44 and the second stabilizing rod 46 when in the open position 95.

In some embodiments, the apparatus 100 may include a set screw 50 and spring to adjust the central rod 45 distance from the stabilizing rods 44, 46, which may be operated to adjust resistance exerted by the rods 44, 45, 46, on flexible filament 200 contacting the rods 44, 45, 46, to account for different flexible filament 200 thicknesses. For example, a set screw 50 may screw into a threaded opening of the central rod 45, and when the set screw 50 is turned the central rod 45 may move forward or backward, guided in by two braces 67 that preferably movably couple the central rod 45 to the tensioner swing arm 48, depending on the direction the set screw 50 is turned, optionally assisted by spring pressure. This forward or backward movement ability of the central rod 45 will add or remove space between the central rod 45 and the stabilizing rods 44, 46, to increase or decrease tension on the movement of the flexible filaments 200 across the filament contact surfaces 41, 42, 43.

While some exemplary shapes and sizes have been provided for elements of the apparatus 100, it should be understood to one of ordinary skill in the art that the securement device 10, base 20, guide assembly 30, tensioner assembly 40, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the apparatus 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the apparatus 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the apparatus 100 may be coupled by being one of connected to and integrally formed with another element of the apparatus 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A crochet assistance apparatus for supporting a flexible filament, the apparatus comprising:

a base;

a guide assembly coupled to the base, wherein the guide assembly comprises a guide hook having a distal guide surface and a proximal guide surface, and wherein the distal guide surface is positioned relatively farther from the base than the proximal guide surface; and a tensioner assembly coupled to the guide assembly, wherein the tensioner assembly is configured to receive the flexible filament, the tensioner assembly having a first filament contact surface, a second filament contact surface, and a third filament contact surface, wherein the tensioner assembly comprises a first stabilizing rod, a central rod, and a second stabilizing rod, wherein the first filament contact surface is disposed on the first stabilizing rod, wherein the second filament contact surface is disposed on the central rod, and wherein the third filament contact surface is disposed on the second stabilizing rod, and wherein the tensioner assembly exerts a resistance to the flexible filament moving through the tensioner assembly.

2. The apparatus of claim 1, wherein the length of flexible filament moves across the first filament contact surface, across the second filament contact surface, and across the third filament contact surface as the flexible filament moves through the tensioner assembly.

3. The apparatus of claim 2, wherein the tensioner assembly imparts a frictional resistance to movement of the flexible filament through the tensioner assembly.

4. The apparatus of claim 1, wherein the central rod is movable relative to one of the first stabilizing rod and the second stabilizing rod.

5. The apparatus of claim 1, wherein the central rod is movable between an open position and a closed position, wherein the central rod is substantially a parallel to the one of the first stabilizing rod and the second stabilizing rod when in the closed position, and wherein the central rod is substantially not parallel to the one of the first stabilizing rod and the second stabilizing rod when in the open position.

6. The apparatus of claim 1, wherein the central rod is movable between an open position and a closed position, wherein the central rod is substantially a parallel to both of the first stabilizing rod and the second stabilizing rod when in the closed position, and wherein the central rod is substantially not parallel to both of the first stabilizing rod and the second stabilizing rod when in the open position.

7. The apparatus of claim 6, wherein the central rod is positioned between the first stabilizing rod and the second stabilizing rod when the central rod is in the closed position.

8. The apparatus of claim 5, wherein the guide assembly comprises a support beam, and wherein the support beam is coupled to the base.

9. The apparatus of claim 8, wherein the central rod is movably coupled to the support beam.

10. The apparatus of claim 8, wherein the central rod is movably coupled to the support beam so that the central rod is pivotable between the open position and the closed position.

11. The apparatus of claim 8, wherein the tensioner assembly comprises a tensioner brace, wherein the first stabilizing rod and the second stabilizing rod are both coupled to the tensioner brace, wherein the central rod comprises a first end and a second end, wherein the first end is pivotally coupled to the support beam, and wherein the second end is removably coupled to the tensioner brace.

12. The apparatus of claim 11, further comprising a retainer that is coupled to the central rod, wherein the retainer is configured to be frictionally coupled to the tensioner brace.

13. The apparatus of claim 8, wherein the support beam is movably coupled to the base.

14. The apparatus of claim 8, wherein the support beam is removably coupled to the base.

15. The apparatus of claim 1, further comprising a securement device that is configured to be secured to a support object, wherein the base is coupled to the securement device, and wherein the securement device comprises a hook and loop fastener.

16. The apparatus of claim 1, further comprising a securement device that is configured to be secured to a support object, wherein the base is coupled to the securement device, and wherein the securement device comprises an elongated strap of flexible material.

17. The apparatus of claim 16, wherein the securement device comprises a hook and loop fastener.

18. The apparatus of claim 16, further comprising a fastener ring that is coupled to the securement device.

19. The apparatus of claim 1, wherein the distal guide surface and the proximal guide surface both extend above the tensioner assembly.

* * * * *